US009868499B2

(12) United States Patent
Mier

(10) Patent No.: US 9,868,499 B2
(45) **Date of Patent: *Jan. 16, 2018**

(54) WATERCRAFT PROPULSION SYSTEM AND METHOD OF PROPELLING A WATERCRAFT THROUGH WATER

(71) Applicant: Hydrojet Drive Systems, Inc., Deland, FL (US)

(72) Inventor: Anthony Frederick Mier, Deland, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/944,309

(22) Filed: Nov. 18, 2015

(65) Prior Publication Data

US 2016/0114874 A1 Apr. 28, 2016

Related U.S. Application Data

(63) Continuation of application No. 14/197,499, filed on Mar. 5, 2014, now Pat. No. 9,193,426.

(60) Provisional application No. 61/773,094, filed on Mar. 5, 2013.

(51) Int. Cl.

| | |
|---|---|
| ***B63H 11/00*** | (2006.01) |
| ***B63H 11/02*** | (2006.01) |
| ***B63H 11/08*** | (2006.01) |
| ***B63B 35/85*** | (2006.01) |

(52) U.S. Cl.

CPC ..... *B63H 11/02* (2013.01); *B63B 35/85* (2013.01); *B63H 11/08* (2013.01); *B63H 2011/082* (2013.01)

(58) Field of Classification Search

CPC ..... B63H 11/00; B63H 11/02; B63H 11/025; B63H 11/04; B63H 11/08; B63H 11/10; B63H 11/101; B63H 11/107; B63H 2011/00; B63H 2011/004; B63H 2011/02; B63H 2011/04; B63H 2011/08; B63H 2011/081; B63H 2011/082; B63H 2011/084; B63H 2011/087

USPC ..... 440/38, 47

See application file for complete search history.

(56) References Cited

U.S. PATENT DOCUMENTS

| | | | | |
|---|---|---|---|---|
| 3,105,353 | A | 10/1963 | Schulz | |
| 3,463,116 | A * | 8/1969 | Dawson | B63B 35/7943 440/39 |
| 3,702,485 | A | 11/1972 | Thompson | |
| 3,889,623 | A * | 6/1975 | Arnold | B63H 11/08 440/39 |
| 4,274,357 | A * | 6/1981 | Dawson | B63B 35/7943 114/55.51 |
| 4,457,724 | A * | 7/1984 | Miyamoto | B63B 35/7943 440/112 |
| 4,459,117 | A | 7/1984 | Jordan | |
| 4,997,399 | A * | 3/1991 | Nakayasu | F01N 13/004 440/88 J |
| 6,533,622 | B1 | 3/2003 | Zwaan et al. | |
| 6,729,931 | B2 * | 5/2004 | Lee | A63H 23/04 440/40 |

(Continued)

*Primary Examiner* — Daniel V Venne

(74) *Attorney, Agent, or Firm* — Michael L. Leetzow, P.A.

(57) ABSTRACT

A watercraft propulsion system includes a motor mounted in a container in a water-tight manner. A shaft extends from the motor through the bottom of the container to an impeller disposed in a housing outside the container. The impeller draws fluid into the housing through and opening on the back of the housing to propel a watercraft through the water.

19 Claims, 5 Drawing Sheets

(56) References Cited

U.S. PATENT DOCUMENTS 7,597,600 B2 * 10/2009 Rui ..... B63H 11/08
123/196 R
7,731,553 B2 * 6/2010 Rui ..... B63B 35/7943
114/55.51

* cited by examiner

WATERCRAFT PROPULSION SYSTEM AND METHOD OF PROPELLING A WATERCRAFT THROUGH WATER

REFERENCE TO RELATED CASE

This application is a continuation application of and claims priority to U.S. Pat. No. 9,193,426, issued on Nov. 24, 2015, which in turn claims priority under 35 U.S.C. § 119 (e) to provisional application No. 61/773,094, filed on Mar. 5, 2013, the contents of both are herein incorporated by reference in their entirety.

BACKGROUND OF THE INVENTION

Field of the Invention

The present invention relates to a watercraft propulsion system and a method propelling a watercraft through water. More specifically, the present invention relates to a motorized watercraft that does not use a propeller, allows the user to navigate back water ways, and to be used in areas with as little as six inches of water.

Many times a paddleboarder or boat operator would like to go into very shallow water to observe wildlife or to pass between bodies of water. Many times, the waterway is too shallow to allow a regular boat with an outboard or inboard motor to pass or is impossible to navigate if a propeller is being used. Also, the shallow water areas may be far from the launch point of the watercraft. So, if a paddleboarder wanted to go to areas where wildlife is, and away from the hustle and bustle of civilization, it may take a long time and a lot of energy for the paddleboarder to get to the destination. Therefore, the current invention allows such a person to motor to the location and then move quietly with the paddles if they so choose. Additionally, the present invention can be used in rescue and military applications where a watercraft with a propeller should not be or can not be used.

Thus, the present invention allows a person to move a watercraft through shallow water without the need to paddle.

SUMMARY OF THE INVENTION

The present invention is directed to a watercraft propulsion system that includes a container to hold a motor, the container having an open top, a bottom, and at least one wall extending from the bottom to the open top, the bottom of the container having an opening therethrough, a motor connected to the bottom of the container in a water-tight manner, a shaft operatively connected to the motor extending from the motor through the opening in the bottom of the container, a housing attached to an outside portion of the container, the housing having a bottom surface and a top surface forming a cavity therebetween, the top surface attached to the outside portion of the container and the bottom surface opposite the top surface, the bottom surface having a first opening and being in fluid communication with the cavity, the housing also having a second opening in a side portion of the housing and in fluid communication with the cavity, and an impeller disposed within the cavity of the housing and operatively attached to the shaft, wherein the impeller when in motion draws fluid into the cavity of the housing through the first opening and pushes the fluid out the second opening.

In some embodiments, the at least one wall comprises 4 walls and is in the shape of a rectangle.

In some embodiments, the cavity of the housing is generally in the shape of the number nine.

In some embodiments, the watercraft is selected from the group of a paddleboard, a canoe, a jon boat, and a surf board.

In yet another aspect, the present invention is directed to a watercraft having a watercraft propulsion system that includes a watercraft having a hull and an opening therein, a container to hold a motor, the container having an open top, a bottom, and at least one wall extending from the bottom to the open top, the bottom of the container having an opening there through, the at least one wall of the container extending above the opening in the hull and the bottom of the container being generally flush with a bottom surface thereof, a motor connected to the bottom of the container in a water-tight manner, a shaft operatively connected to the motor extending from the motor through the opening in the bottom of the container, a housing attached to an outside portion of the container, the housing having a bottom surface and a top surface forming a cavity therebetween, the top surface attached to the outside portion of the container and the bottom surface on an opposite of the housing, the bottom surface having a first opening and being in fluid communication with the cavity, the housing also having a second opening in a side portion of the housing and in fluid communication with the cavity, and an impeller disposed within the cavity of the housing and operatively attached to the shaft, wherein the impeller when in motion draws fluid into the cavity of the housing through the first opening and pushes the fluid out the second opening.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention and, together with the description, serve to explain the principles and operations of the invention.

DETAILED DESCRIPTION OF THE PREFERRED EMBODIMENTS

Figure 1:
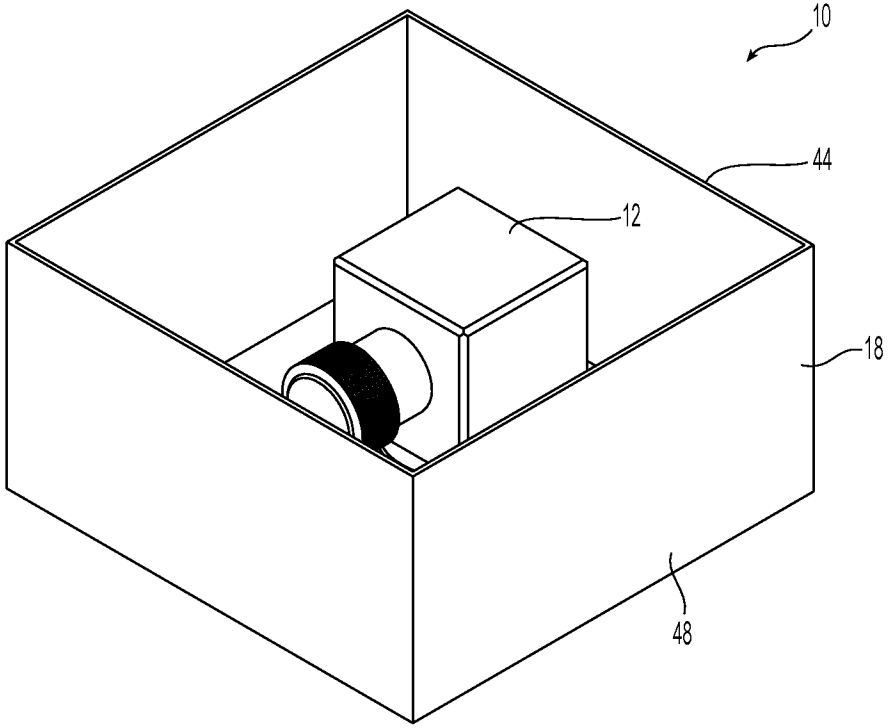
FIG. 1 is a perspective view of one embodiment of a watercraft propulsion system according to the present invention.

Reference will now be made in detail to the present preferred embodiment(s) of the invention, examples of which are illustrated in the accompanying drawings. Whenever possible, the same reference numerals will be used throughout the drawings to refer to the same or like parts.

Figure 2:
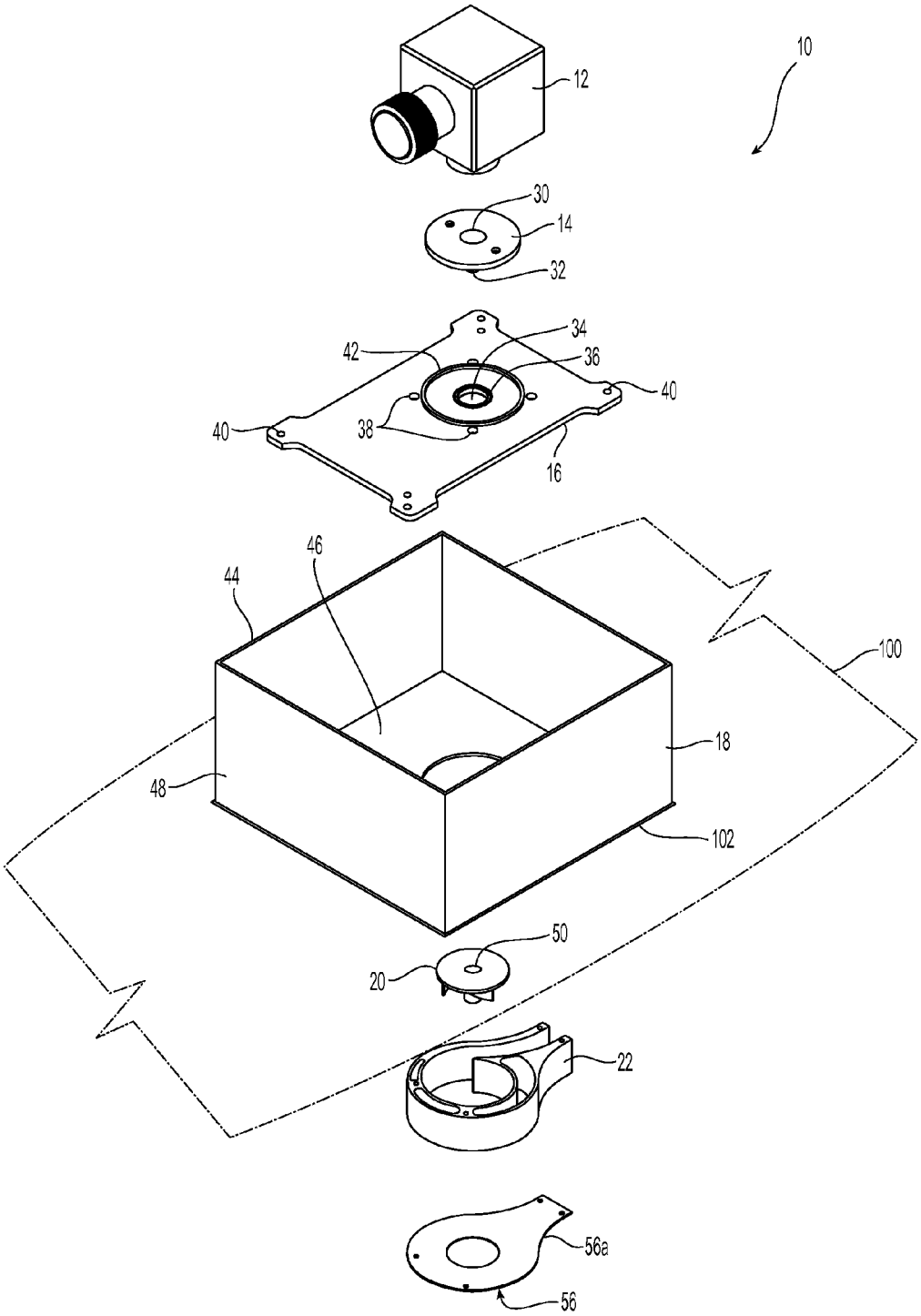
FIG. 2 is an exploded, perspective view of the watercraft propulsion system of FIG. 1 in reference to a watercraft.
Figure 3:
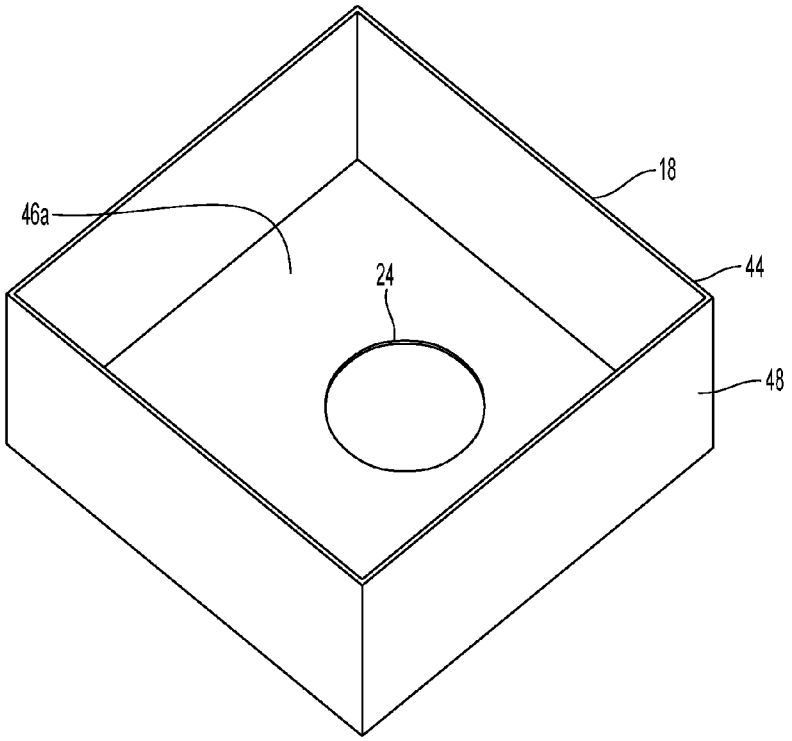
FIG. 3 is a top perspective view of a container of the watercraft propulsion system of FIG. 1.

One embodiment of a watercraft propulsion system 10 is illustrated in the figures. Referring to FIGS. 1 and 2, the watercraft propulsion system 10 has a motor 12, a shaft 14 extending from the motor 12 through a motor mount 16. The motor mount 16 in turn is secured to a container 18. The container 18 is mounted to the watercraft 100 through a hole 102 as seen in FIG. 2. Preferably, the hole 102 is about two thirds of the way back in the watercraft 100, although it could be placed anywhere in the watercraft 100 and still fall within the scope of the present invention. An impeller 20 is connected to the shaft 14 and is disposed in the housing 22. As seen in FIG. 3, the container 18 has an opening 24 that allows the impeller 20 to pass therethrough even if the impeller 20 is attached to the shaft 14.

The motor 12 as illustrated in the figures is a representation of a motor generally, which is preferably a small gasoline-type engine. More particularly, the motor 12 is a one horsepower engine that has 25 cc displacement. A Honda GX35 engine was used and allows many miles of travel on less than a quart of fuel. However, any type of motor would work, e.g., electric, diesel, or gasoline, and would fall within the scope of the present invention. Additionally, a larger or smaller motor may also be substituted, depending on the usage, the person riding the watercraft 100, the size of the watercraft 100, and the speed at which the rider would like to travel.

In this embodiment, the clutch was removed from the off-the-shelf motor 12 and the shaft 14 was attached to the motor 12. The shaft 14 has a back end 30 that is configured to attach to the motor 12. In the present embodiment, that means a large discus-shaped back end 30. On the other side of the shaft 14 is a smaller, elongated portion 32 that protrudes through the motor mount 16 and attaches to the impeller 20. The elongated portion 32 of the shaft 14 is about ¾" in diameter, but other sizes and shapes could be used.

The motor 12 is preferably mounted to a motor mount 16. The motor mount 16 is flat and preferably machined from aluminum to accommodate several features. First, the opening 34 of the motor mount 16 allows the front portion 32 of the shaft 14 to pass therethrough. Preferably, although known to those in the art, the opening 34 would have a seal 36 to seal the opening 34 and not allow water to enter into the container 18, where it could damage the motor 12. Holes 38 are used in attaching the motor 12 thereto and holes 40 are used in attaching the motor mount 16 to the container 18. A raised ring 42 is preferably machined into the motor mount 16 and would fit between the back end 30 of the shaft 14 and the housing on the motor 12.

The container 18 is illustrated as a square box that is sufficiently large enough to fit the motor 12 and allow for access to the motor mount 16 to secure it into the container 18. A container that is 12"×12" has been determined to be sufficiently large to allow the motor noted above to fit comfortably therein. This size also fits well in the hulls of most watercraft. The container 18 has an open top 44 and a bottom 46, with the bottom 46 having the opening 24. Bottom 46 has an inside portion 46*a* (see FIG. 3) and an outside portion 46*b* (See FIG. 4). The container 18 also has at least one wall 48 that extends from the open top 44 to the bottom 46. Thus, the container 18 (and probably also the motor mount 16) may be circular and still fall within the scope of the current invention. As illustrated in the figures, the container 18 is a square, but may also be a rectangle or any other shape as desired. The container 18 is secured within the opening 102 in the watercraft 100 in any appropriate manner. Obviously the container 18 needs to be secure, but also sealed around the bottom 46 and the top of the hull of the watercraft 100.

The opening 24 in the container 18 is preferably large enough to allow impeller 20 to pass therethrough. This allows the removal of the motor 12 and motor mount 16 from the container 18 without having to first remove the housing 22 and the impeller 20. However, the opening 24 could be smaller than the impeller 20 if so desired. While not illustrated, a gasket or other water sealing device is naturally placed around the opening 24 of the container 18 so that when the motor mount 16 is secured to container 18, the opening 24 is sealed and water does not get into the container 18 and damage the motor 12. One of ordinary skill in the art would know the type (e.g., neoprene, rubber, etc.) and size to use.

The impeller 20 is secured to the shaft 14 in any appropriate manner. In the present invention, there is an opening 50 that allows a screw or rivet to be used to secure the impeller 20 to the shaft 14. The impeller 20 is a three inch four-bladed impeller by Flo-Tech, but any appropriate impeller or size of impeller can be used and come within the scope of the present invention.

Figure 4:
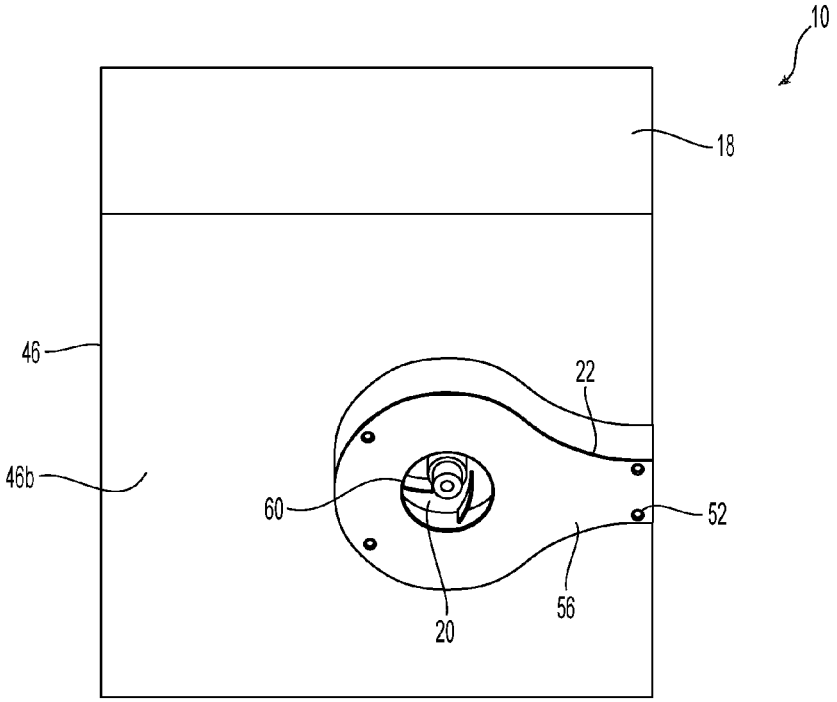
FIG. 4 is a bottom perspective view of the watercraft propulsion system of FIG. 1 illustrating the housing attached to the container.

The housing 22 is attached to the bottom 46 of the container 18 as illustrated in FIG. 4. The manner of attachment is not important, but is done in the present embodiment with screws into the bottom 46 through holes 52 on the housing 22. While the housing 22 does not have to be sealed tightly against the bottom 46 of the container 18, it is preferably.

Figure 5:
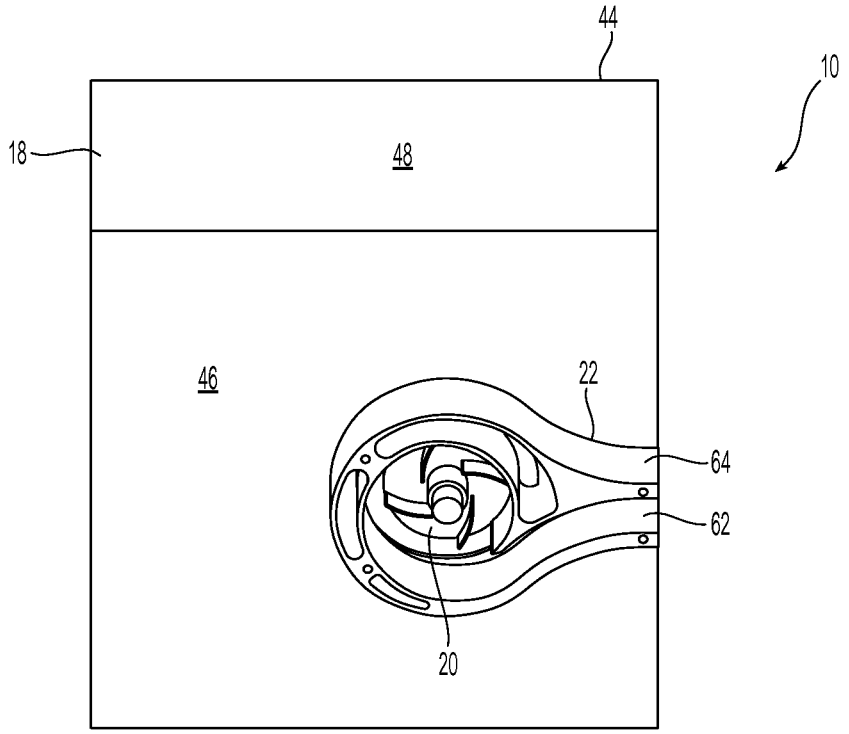
FIG. 5 a bottom perspective view of the watercraft propulsion system of FIG. 1 illustrating the housing attached to the container with the housing having the bottom surface removed to show the impeller and the cavity.
Figure 6:
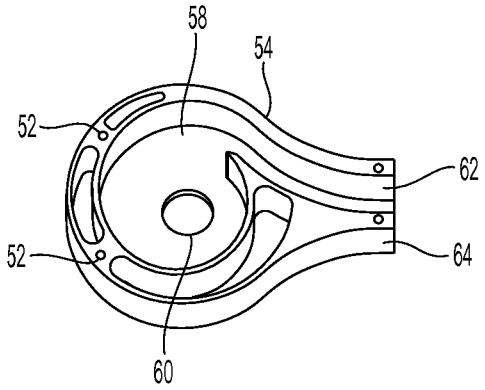
FIG. 6 is a top perspective view of the housing.

Referring to FIGS. 5 and 6, housing 22 has a top surface 54 and a bottom surface 56, illustrated in FIG. 2 as a separate piece 56*a*. However, it should be noted that the housing 22 can be milled as a single, unitary piece from a single piece of aluminum. The top surface 54 and the bottom surface 56 or piece 56*a* form a cavity 58 in the housing 22. The cavity 58 is illustrated as being in the shape that generally approximates a figure nine or even a six depending on the point of view. See FIG. 6. The bottom surface 56 or piece 56*a* of housing 22 has a first opening 60 that is aligned with the center of the impeller 22. See FIGS. 4 and 5. The first opening 60 acts as an inlet for the watercraft propulsion system 10 as explained in more detail below. The housing 22 has a second opening 62 that acts as an outlet for the watercraft propulsion system 10. A screen can be attached to the housing 22 to prevent weeds, trash, and other debris from entering the cavity 58 and interfering with the impeller 20 or clogging the housing 22. As best seen in FIGS. 5 and 6, the second opening 62 is in a side portion 64 of the housing 22. The housing 22 is preferably made from milled aluminum but could be made from any appropriate material. Naturally, the lighter the material used in all of the watercraft propulsion system 10, the smaller the motor 12 is needed for the same watercraft 100. It should be noted that the housing 22 has a height of about one inch. This allows the watercraft 100 with the watercraft propulsion system 10 to move through shallow water. Many of the boards (both paddle and surf) have fins on them that are somewhere between two and four inches, and therefore, the height of the housing 22 is less, allowing safe passage in as little as six inches of water.

Figure 7:
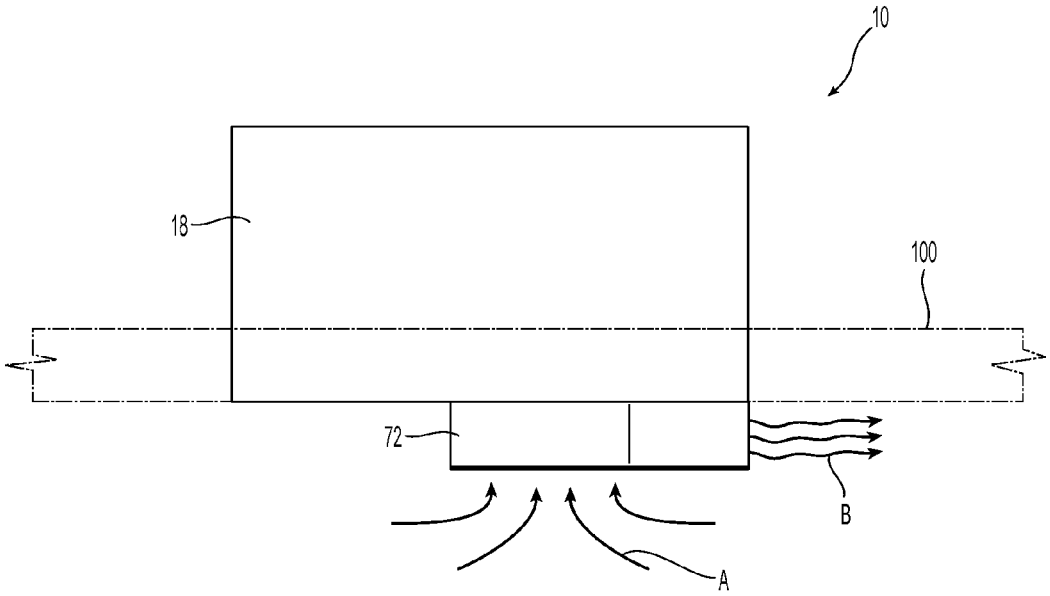
FIG. 7 is an elevational view illustrating the flow of a liquid through the housing during operation of the watercraft propulsion system.

When the motor 12 is operating, the impeller 20 spins in a counter clockwise direction when viewed from the bottom of the watercraft propulsion system 10. This causes the water in which the watercraft with the watercraft propulsion system 10 is sitting to be drawn into the housing 22, and the cavity 58 in particular, as illustrated by the arrows A in FIG. 7. The water, being moved at a relatively high rate, then passes through the cavity 58 and out the second opening 62 of the housing 22 and rearwardly relative to the watercraft 100 as illustrated by the arrows B. This thrust from the housing 22 in turn causes the watercraft to move forward in the water.

The operator of watercraft propulsion system 10 preferably has controls attached to the container 18 that allow the operator to control the speed of the motor 12, and thus the speed of the watercraft 100, can be easily accessed using the paddle. Alternatively, the controls could be attached directly to the watercraft 100 and allow for the operator to use his/her foot to control the speed or by a hand control. A quick shut off or kill switch as is known in the art is also preferable in the event of an emergency or the operator falls off of or out of the watercraft 100, as the case may be.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

I claim:

1. A watercraft propulsion system comprising:

a container to hold a motor, the container having a bottom, the bottom of the container having an opening therethrough;

a motor disposed in the container in a water-tight manner, a shaft operatively connected to the motor extending from the motor through the opening in the bottom of the container;

a housing connected to an outside portion of the container, the housing having a bottom surface and a cavity, the bottom surface having a first opening in fluid communication with the cavity, the housing also having a second opening in fluid communication with the cavity; and an impeller disposed within the cavity of the housing and operatively attached to the shaft, wherein the impeller when in motion draws fluid into the cavity of the housing through the first opening and pushes the fluid out the second opening.

2. The watercraft propulsion system according to claim 1, wherein the container has a top and at least one wall extending from the bottom to the top.

3. The watercraft propulsion system according to claim 2, wherein the watercraft propulsion system is mounted in an opening in a hull of a watercraft, the at least one wall extending above the opening in the hull of the watercraft to prevent water from entering the container.

4. The watercraft propulsion system according to claim 1, wherein the container is installed in an opening in a hull of a watercraft.

5. The watercraft propulsion system according to claim 4, wherein the watercraft is selected from the group of a paddleboard, a canoe, a jon boat, and a surf board.

6. The watercraft propulsion system according to claim 4, wherein the watercraft propulsion system is mounted in a rear third portion of the watercraft.

7. The watercraft propulsion system according to claim 1, wherein the motor is an electric motor.

8. The watercraft propulsion system according to claim 1, wherein the motor is a gas engine.

9. The watercraft propulsion system according to claim 1, wherein the first opening and the second opening are offset at 90 degrees from one another.

10. The watercraft propulsion system according to claim 1, wherein the cavity of the housing is generally in the shape of the number nine.

11. The watercraft propulsion system according to claim 1, wherein the watercraft propulsion system is mounted in an opening in a hull of a watercraft and the bottom of the container is generally flush with a bottom surface of the hull.

12. The watercraft propulsion system according to claim 1, wherein the fluid enters the housing in a direction that is orthogonal to the direction the fluid leaves the housing.

13. A watercraft having a watercraft propulsion system comprising:

a watercraft having a hull and an opening therein;

a container to hold a motor disposed in the opening in the hull, the container having a bottom, the bottom of the container having an inside portion and opening therethrough;

a motor connected to the inside portion of the bottom of the container in a water-tight manner, a shaft operatively connected to the motor extending from the motor through the opening in the bottom of the container;

a housing attached to an outside portion of the container, the housing having a bottom surface and a cavity formed by the housing and a portion of the container, the bottom surface having a first opening in fluid communication with the cavity, the housing also having a second opening in fluid communication with the cavity; and an impeller disposed within the cavity of the housing and immediately adjacent the container and operatively attached to the shaft of the motor, wherein the impeller when in motion draws fluid into the cavity of the housing through the first opening and pushes the fluid out the second opening.

14. The watercraft propulsion system according to claim 13, wherein the fluid enters the housing in a direction that is orthogonal to the direction the fluid leaves the housing.

15. The watercraft propulsion system according to claim 13, wherein the watercraft is selected from the group of a paddleboard, a canoe, a jon boat, and a surf board.

16. The watercraft propulsion system according to claim 13, wherein the watercraft propulsion system is mounted in a rear third portion of the watercraft.

17. The watercraft propulsion system according to claim 13, wherein the outside portion of the container being generally flush with a bottom surface of the watercraft.

18. The watercraft propulsion system according to claim 13, wherein the housing has a top surface, the top surface in part forming the cavity and mounted to the outside portion of the container.

19. A watercraft propulsion system comprising:

a container to hold a motor, the container having a bottom, the bottom of the container having an opening therethrough;

an electric motor disposed in the container in a water-tight manner, a shaft operatively connected to the electric motor extending from the motor through the opening in the bottom of the container;

a housing connected to an outside portion of the container, the housing having a bottom surface and a cavity, the bottom surface having a first opening and being in fluid communication with the cavity, the housing also having a second opening in fluid communication with the cavity; and an impeller disposed within the cavity of the housing and operatively attached to the shaft, wherein the impeller when in motion draws fluid into the cavity of the housing through the first opening and pushes the fluid out the second opening.

* * * * *